US005382931A

United States Patent [19]

Piloto et al.

[11] Patent Number: 5,382,931

[45] Date of Patent: Jan. 17, 1995

[54] WAVEGUIDE FILTERS HAVING A LAYERED DIELECTRIC STRUCTURE

[75] Inventors: Andrew J. Piloto, Columbia; Kevin A. Leahy, Eldersburg; Bruce A. Flanick, Columbia; Kawthar A. Zaki, Potomac, all of Md.

[73] Assignee: Westinghouse Electric Corporation, Pittsburgh, Pa.

[21] Appl. No.: 168,502

[22] Filed: Dec. 22, 1993

[51] Int. Cl.[6] ..... H01P 1/207; H01P 3/16

[52] U.S. Cl. ..... 333/208; 333/248

[58] Field of Search ..... 333/202, 208–212, 333/239, 248

[56] References Cited

U.S. PATENT DOCUMENTS

| | | | |
|---|---|---|---|
| 3,497,835 | 2/1970 | Tsuda | 333/210 |
| 3,697,898 | 10/1972 | Blachier et al. | 333/21 A |
| 3,969,692 | 7/1976 | Williams et al. | 333/212 |
| 4,060,779 | 11/1977 | Atia et al. | 333/212 |
| 4,489,293 | 12/1984 | Fiedziuszko | 333/202 |
| 4,899,118 | 2/1990 | Polinski, Sr. | 333/246 |
| 4,963,844 | 10/1990 | Konishi et al. | 333/212 X |
| 4,990,870 | 2/1991 | Reindel | 333/208 |

*Primary Examiner*—Seungsook Ham

[57] ABSTRACT

Waveguide filters having a laminated dielectric structure for resonating at a predetermined frequency and having a series of longitudinally spaced resonators. A selected plural number of individual layers of high dielectric low temperature co-fired ceramic are laminated into a monolithic structure and then plated with a conductive material. Each of the individual layers is dimensioned and the number of layers is selected so that the unit resonates at the predetermined frequency. A waveguide filter is also described where a select plural number of contiguous layers of low temperature co-fired ceramic are laminated and plated with a conductive material. A series of vertically placed vias are positioned so as to form a perimeter of a waveguide filter. A plurality of individual layers of low temperature co-fired ceramic are laminated to the monolithic structure to form a laminated unit so that electrical components and the waveguide filter can be integrated into a single package.

15 Claims, 7 Drawing Sheets

WAVEGUIDE FILTERS HAVING A LAYERED DIELECTRIC STRUCTURE

BACKGROUND OF THE INVENTION

1. Field of the Invention

The present invention relates generally to electrical waveguides, and more particularly to waveguide filters for passing selected radio frequencies in electronic receivers and exciters.

2. Discussion of Related Art

Optimal electronic receivers must detect a broad range of radio frequencies (RF). The wide bandwidth exposes such receivers to an increased probability of receiving multiple signals simultaneously. In a radar application, these multiple signals could originate, for example, from electronic countermeasures of a hostile adversary, from other non-combative radiators, or from the radiator of the same radar system under certain receiving conditions. The simultaneous reception of such multiple signals can result in cross modulation, which degrades receiver performance.

Conventional techniques for decreasing the probability of cross modulation in receivers having wide bandwidths include the channelization of the receiver front end. Channelization involves dividing the receiver path into a series of channels using a series of filters configured in a switched filter bank with each filter tuned to a particular frequency band. Waveguide cavity, combine, and suspended stripline are a few examples of techniques that have been used to implement waveguide filters. Unfortunately, each of these prior structures lacks the advantages of small volume and light weight needed for many radar applications.

Waveguide cavity filters have achieved a high quality of electrical performance in passing selected radio frequencies and providing low insertion loss and high out of band isolation. These filters are constructed of a metallic shell having air-filled cavities formed by precision machining. Rectangular, square, and circular air-filled waveguides have been constructed to realize single mode or dual mode filter response. Cavity filters, however, are expensive to produce requiring special tuning to achieve desired performance, and are prohibitively large and heavy for certain applications.

One proposed technique has significantly reduced the size of dual mode waveguide filters by inserting a temperature stable ceramic material having a high dielectric constant and high quality factor into the cavities previously filled with air. This reduction resulted from the fact that the linear dimensions of a waveguide filter are inversely proportional to the square root of the effective relative dielectric constant within the waveguide. Despite the significant reduction in waveguide size, the proposed technique still required machining and tuning of the metallic shell and the placement of the dielectric within the metallic shell. These steps are labor-intensive and expensive under presently available manufacturing processes. Consequently, waveguide filters having cavities loaded with a dielectric resonator may not easily be integrated into a single package containing other electronic components, such as monolithic microwave integrated circuits (MMIC).

In light of the foregoing, there is a need for a miniature microwave filter that can be manufactured inexpensively, repeatedly, and in large quantities without the need for extensive tuning. In addition, there is a need for a waveguide filter that can be combined into a single integrated package with other electronic components.

SUMMARY OF THE INVENTION

Accordingly, the present invention is directed to a waveguide filter that substantially obviates one or more of the limitations and disadvantages of the described prior arrangements.

Additional advantages of the invention will be set forth in the description that follows, and in part will be apparent from the description, or may be learned by practice of the invention. The advantages of the invention will be realized and attained by the system particularly pointed out in the written description and claims hereof as well as the appended drawings.

To achieve these and other advantages in accordance with the purpose of the invention, as embodied and broadly described herein, the invention comprises a waveguide filter, comprising a monolithic structure having a series of coupled resonators. The monolithic structure includes a selected number of laminated dielectric layers, each of the laminated layers having means for defining a perimeter of the series of coupled resonators of a selected dimension, the number of dielectric layers and the dimension of the perimeter being selected in accordance with a predetermined resonant frequency for the monolithic structure. A plating of conductive material covers the monolithic structure.

In another aspect, the invention comprises a waveguide filter, comprising a laminated unit including a top dielectric layer, a bottom dielectric layer, and a plurality of stacked dielectric layers between the top and bottom layers. A select number of the plurality of stacked dielectric layers have means for defining a perimetric outline of a series of coupled resonators of a waveguide filter. The number of stacked dielectric layers and the dimension of the perimetric outline are selected in accordance with a predetermined resonant frequency for the defined waveguide filter.

In another aspect, the invention comprises a method of fabricating a waveguide filter, comprising the steps of selecting and stacking a plural number of contiguous layers of dielectric material, positioning vias through the contiguous layers to form a perimeter of a series of coupled resonators, each of the resonators being dimensioned and the number of contiguous layers being selected to resonate at a predetermined frequency. The method further comprises the steps of filling the vias with conductive material, plating a top surface and a bottom surface of the stack of contiguous layers with a conductive material, stacking a plurality of individual layers of dielectric material with the contiguous layers, where the contiguous layers have a high dielectric constant relative to the individual layers, and co-firing the stack of contiguous and individual layers to form a monolithic, laminated unit.

It is understood that both the foregoing general description and the following detailed description are exemplary and explanatory and are intended to provide further explanation of the invention as claimed.

The accompanying drawings, which are incorporated in and constitute a part of this specification, illustrate several embodiments of the invention and together with the description serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

The present invention is based upon the well-known principle that the linear dimension of a waveguide filter having a solid body with a relative dielectric constant $\epsilon_r$ will be less than the linear dimension of a known waveguide filter having an air-filled body by a factor of $(1/\epsilon_r)^{\frac{1}{2}}$ when resonating at the same frequency.

Figure 1:
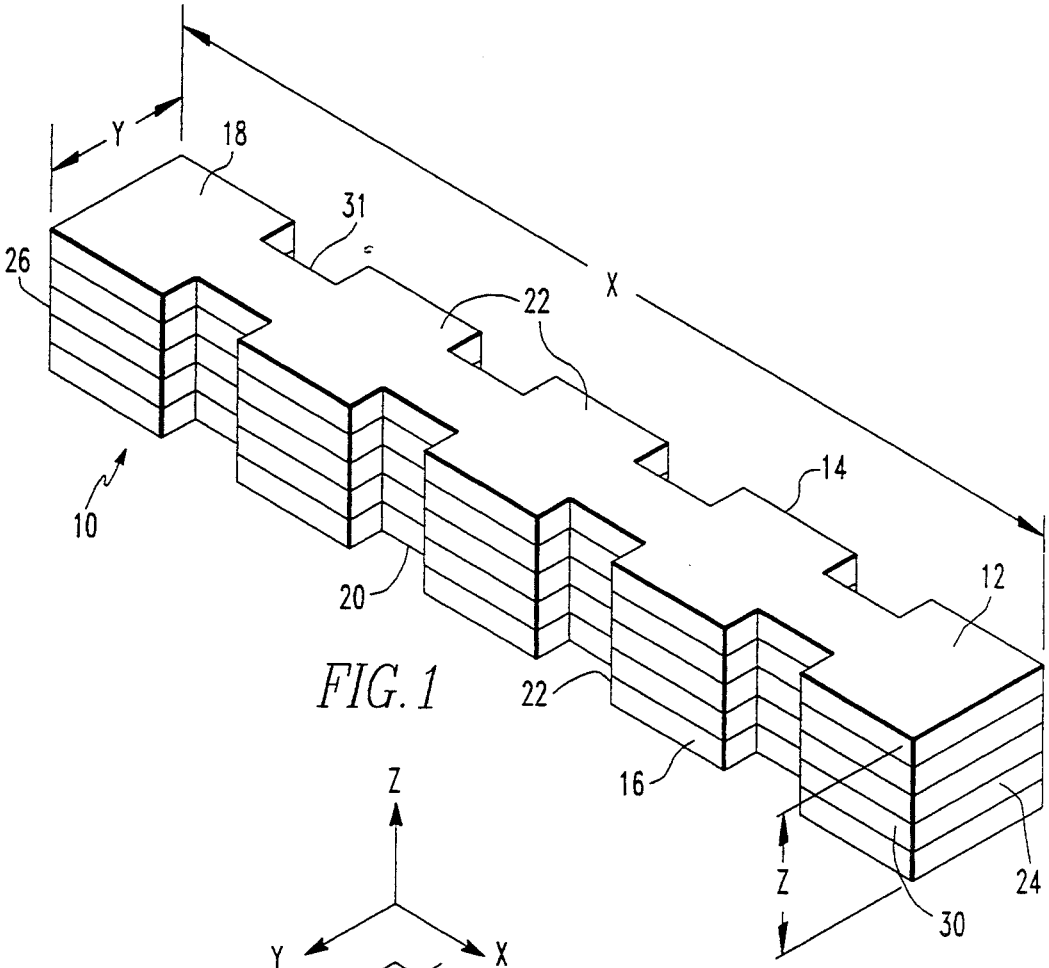
FIG. 1 is a perspective view of a waveguide filter according to a first embodiment of the present invention.

Referring to FIG. 1, a waveguide filter 10 comprises a unitary body 12 having an elongated longitudinal axis in the x-direction. The waveguide filter typically has a rectangular block shape with two vertical sides 14 and 16 substantially parallel and extending in the x–z directions and two horizontal sides 18 and 20 substantially parallel and extending in the x–y directions. A series of spaced sections 22, or resonators, within the unitary body 12 are cascaded along the longitudinal axis with a series of connecting irises 31 connecting the sections 22. Each section 22 comprises a region of enlarged width and/or height with respect to the portion 31 of the unitary body 12 joining the sections. The waveguide filter 10, therefore, has an alternating pattern of enlarged and narrowed widths and/or heights in the y-direction and z-direction, as viewed along the longitudinal axis in the x-direction.

Depending upon the dimensions of each of the resonator sections 22, the spacing of the cascaded resonator sections 22, the dimensions of connecting cross section 31, the length of the unitary body 12 in the x-direction, and the dielectric constant of the unitary body, an electromagnetic wave of a select frequency will propagate from one end 24 of the body 12 to a second end 26 along the longitudinal axis. As is readily known to one of ordinary skill in the art, each of these dimensions may be calculated analytically with precision for a body having a predetermined dielectric constant $\epsilon_r$ and resonating at a predetermined frequency. These calculations generally involve the application of wave propagation theory with the assistance of computer modeling. Alternatively, the dimensions of a desired waveguide filter for a selected dielectric constant could be determined empirically. Typically, the completed waveguide filter 10 is machined from a solid piece of material having the predetermined dielectric constant $\epsilon_r$.

In accordance with the present invention, the waveguide filter comprises a monolithic structure having a series of coupled resonators, the monolithic structure including a selected number of laminated dielectric layers, each of the laminated layers having means for defining a perimeter of the series of coupled resonators of a selected dimension, the number of dielectric layers and the dimension of the perimeter being selected in accordance with a predetermined resonant frequency for the monolithic structure.

Figure 2:
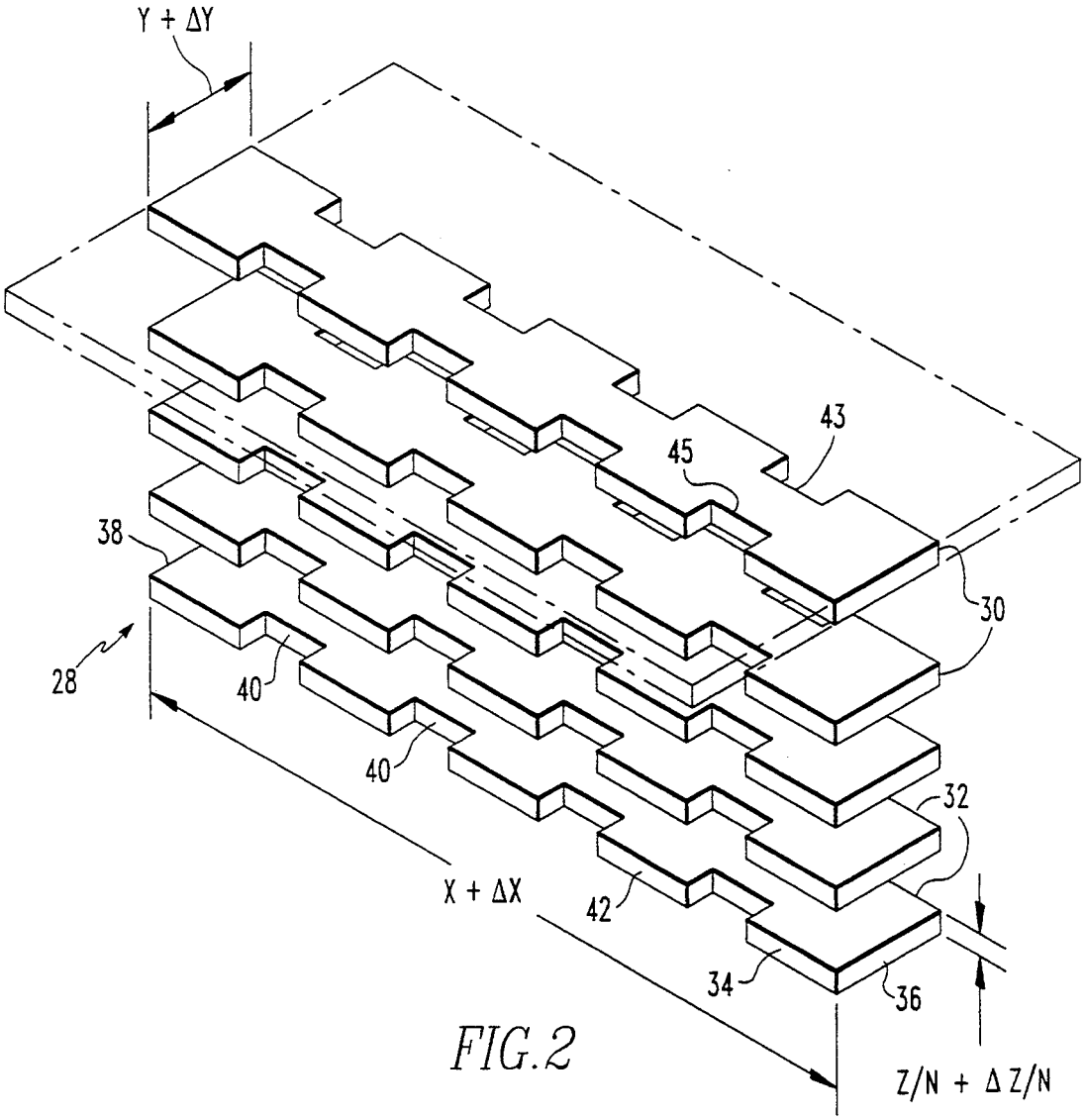
FIG. 2 is an exploded view of the waveguide filter shown in FIG. 1.

As herein embodied and generally referenced at 28 in FIG. 2, the individual dielectric layers 30 comprise pieces of ceramic. Preferably the ceramic dielectric is low temperature co-fired ceramic (LTCC). Glass particles and ceramic fillers along with select polymers, plasticizers, and solvents are melted together to form LTCC. By varying the concentration of the ceramic fillers during fabrication, the dielectric constant for LTCC is readily adjustable. Furthermore, high conductivity metals plate well to LTCC. LTCC permits the inexpensive fabrication of multi-layer ceramic structures applicable to the interconnection and/or packaging of electronic circuitry.

The initial state of LTCC before being formed into a ceramic structure is called the "green" state. As described below, conductors and interconnecting vias, for example, may be added to the individual dielectric layers 30 while the LTCC is in the green state. To form the intermediate structure of the intended application of the LTCC, such as a circuit package or circuit board, the individual layers of LTCC are laminated together under predetermined temperature and pressure. After lamination, LTCC is fired at high temperatures to create a rigid LTCC structure. Final external dimensions are obtained by cutting the LTCC structure.

Of particular interest in the application of LTCC to the invention described herein, is the accurate dimensional tolerances achievable in the LTCC process and the ability to apply high conductivity metals such as gold, silver, or copper. The relatively low temperatures of the final firing process during LTCC fabrication enable these two properties to be achieved. These properties are a particular discriminator in the application described herein.

Figure 3:
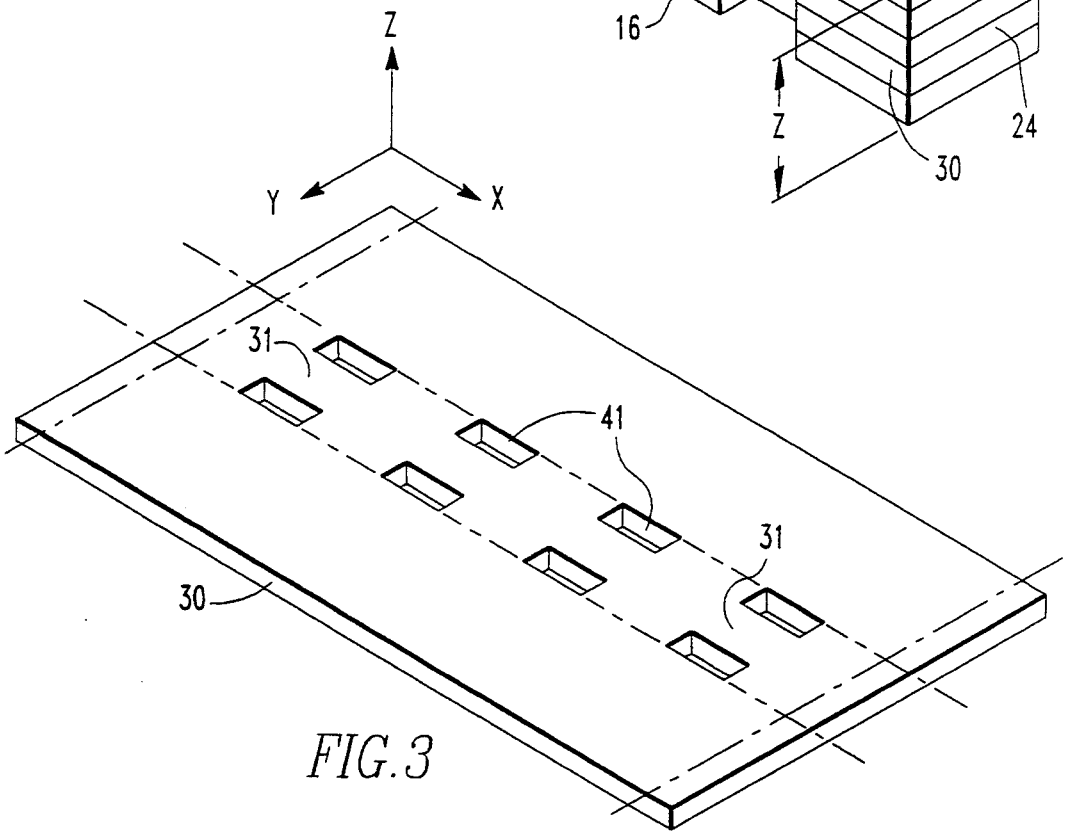
FIG. 3 is a perspective view of an individual layer of LTCC of the waveguide filter shown in FIG. 1.

To form the individual layers 30, a plural number of pieces of LTCC tape are first cut from a roll having a desired high dielectric constant, dielectric loss, and thickness. For waveguide filters at microwave frequencies, a high dielectric constant would generally be in the range of 2 to 200, with a dielectric loss tangent of less than $10^{-4}$. Using the dimensions derived by computer modeling for a selected dielectric constant, a pattern of holes 41 or orifices is cut into each piece of LTCC as shown in FIG. 3. These holes determine the dimension in the y direction of the connecting irises 31 of the completed waveguide filter. A number of layers of LTCC having identical patterns are then laminated together and fired to form the ceramic structure. After firing, the rigid ceramic structure is then cut in the x–z plane to form the finished structure of the desired waveguide filter 10 illustrated in FIG. 1.

The regions of narrowed width 31 trace the outline of a series of alternately spaced resonator sections 42 along the longitudinal axis. The distances between each side 32 and 34 and between each side 43 and 45 of an LTCC piece after shaping correspond to the widths of the desired waveguide filter 10 and associated irises 31 in the y direction shown in FIG. 1. As mentioned, these widths are determined analytically or empirically based on the predetermined resonant frequency and the dielectric constant of the resulting filter body. As in the case of cutting the length x for each piece, the sides are cut to a width in excess of the width calculated for the desired waveguide filter. Specifically, each pattern is cut to provide for at least a length $y+\Delta y$ and a width of at least a length $x+\Delta x$, where $\Delta x$ and $\Delta y$ is an amount of anticipated shrinkage described below. For the preferred Green Tape TM brand LTCC available from DuPont Electronics, co-firing causes the LTCC layers to shrink in the x and y directions by 12% +/−0.2%. Each piece of Green Tape TM will also shrink about 17% in the z-direction, which corresponds to a co-fired thickness of about 3.7 mils. In other words, in shaping each layer and in selecting the number of layers to be stacked, $\Delta x$ is 12%, $\Delta y$ is 12%, and $\Delta z$ is 17%. A linear relationship exists, however, between the applied pressure and the magnitude of LTCC shrinkage during co-firing.

Alternatively, the longitudinal portions 30 can be punched directly from the LTCC tape and subsequently fired and cut to finished dimensions. Punching enables the large volume production of shaped LTCC layers with a high degree of repeatability.

After cutting or punching of the LTCC tape is complete, the individual layers 30 are stacked contiguously. The stacking of the dielectric layers 30 forms the body of a waveguide filter 10. The select number of individual layers 30 chosen depends upon the height of the desired waveguide filter 10 in the z-direction, and essentially upon the filter response desired. Each additional LTCC layer 30 will increase the volume of the longitudinally spaced resonator sections 42 proportionately. The number of individual layers 30 is selected so that the stacking of the layers reaches a height in excess of the height calculated for the desired waveguide filter 10. That is, the number of layers is selected to approximate $z+\Delta z$, where $\Delta z$ corresponds to an amount of anticipated shrinkage described below.

A monolithic structure of laminated dielectric material is formed by bonding the stack of contiguous layers through a laminating process. The subsequent laminated stack of contiguous layers is fired to form a rigid structure. The resulting monolithic unit has a dielectric constant in accordance with the dielectric constants of the individual layers 30 of LTCC and a z dimension in accordance with a calculated value to determine the resonant characteristics of the filter. Under these co-firing conditions, the stack of individual LTCC pieces 30 shrinks in the x, y, and z dimensions and melds together to become a solid, monolithic structure. The final dimensions x and y are determined by trimming the co-fired ceramic in the y–z and x–z planes respectively. It will be readily apparent to one of ordinary skill in the art that predictable shrinking may be attained under a variety of co-firing conditions.

In accordance with the present invention, a waveguide filter comprises a plating of conductive material covering the monolithic structure. As herein embodied, gold is plated over the outer exposed surfaces of the LTCC unit. This plating provides the outer conductor of the waveguide structure to guide and contain a propagating electromagnetic wave of the predetermined frequency within the waveguide body. As is readily known, the gold plating is connected to ground upon installation of the filter.

By controlling the dimensions for the individual layers and the co-firing parameters, the resulting monolithic ceramic unit may be fabricated with precise tolerances. The fabrication of multiple filters using layered dielectric structures will yield negligible variation from lot to lot. Consequently, tuning of the waveguide filter is unnecessary. Moreover, by co-firing a waveguide filter from LTCC tape instead of machining a complex structure from a block of ceramic or the like, the production process for filters of the present invention is streamlined.

It will be apparent to those skilled in the art that numerous modifications and variations can be made in the first embodiment of the present invention and in construction of this waveguide filter without departing from the scope or spirit of the invention. As an example, an input and output feed may be attached to either end 36 or 38 of an individual LTCC layer 30 to couple the waveguide filter to microwave frequencies. These feeds could be microstrip, stripline, or coaxial, for example. Alternatively, a standard RF connector at either end of the waveguide filter could provide the input and output feeds. Furthermore, the individual layers 30 could also be uniquely dimensioned so that stacking results in a waveguide body having a shape other than rectangular, such as cylindrical. As is readily apparent, the present invention may be modified to accommodate various other shapes and sizes of a waveguide filter, as well as a variety of dielectric constants.

In-a second embodiment of the present invention, a waveguide filter comprises a laminated unit, the laminated unit including a top dielectric layer and a bottom dielectric layer, and a plurality of stacked dielectric layers between the top and bottom layers, a select number of the plurality of stacked dielectric layers having means for defining a perimetric outline of a series of coupled resonators of a waveguide filter, the number of stacked dielectric layers and the dimension of the perimetric outline being selected in accordance with a predetermined resonant frequency for the defined waveguide filter.

In accordance with the present invention, the waveguide filter comprises a laminated unit, the laminated unit including a top dielectric layer, a bottom dielectric layer, and a plurality of stacked dielectric layers between the top and bottom layers. As herein embodied, the waveguide filter generally referenced at 44 in FIG. 4, includes stacked dielectric layers, or contiguous layers, 46 of ceramic material. Preferably, the ceramic used is LTCC. As described above, the layers 46 are cut or punched in equally sized geometries from a roll. The LTCC pieces 46 are substantially rectangular in shape including two sides 48 and 50 and two ends 52 and 54. Because the contiguous layers 46 of LTCC will be used to form the body of a waveguide filter resonating at microwave frequencies, the dielectric constant for the contiguous layers generally would be in the range of 2 to 200. The finished length of the cut pieces 46 and the relative dimensional relationship between intended locations of components 74 and vias 62 as a minimum need only exceed the length calculated for the desired waveguide filter 10 by a shrinkage factor $\Delta x$ and $\Delta y$, for example 12%. The pieces 46 may be cut longer if desired, however. Typically, each piece 46 is cut to the same length.

In accordance with the present invention, the waveguide filter includes an input feed and an output feed for coupling microwave frequencies to the contiguous layers. As herein embodied and referenced at FIG. 5, the input feed 56 and output feed 58 are plated circuit paths printed on a select contiguous layer 60 of LTCC. As readily known in the art, the input feed 56 and output feed 58 could be stripline, microstrip or coaxial, for example. Specifically, a first gold strip is plated near one end 52 of one surface of the select contiguous layer 60 to form an input feed 56, and a second gold strip is plated near an opposite end 54 of the same surface of the select contiguous layer 60 to form an output feed 58. The input feed 56 and output feed 58 are positioned so that the shortest distance between the input feed and the output feed after co-firing equals the length in the x-direction calculated for the desired waveguide filter 10.

The waveguide filter of the present invention further comprises a select number of the plurality of stacked dielectric layers having means for defining a perimetric outline of a series of coupled resonators. Preferably, the means for defining comprises a series of vias passing through the contiguous layers and being plated with a conductive material. As herein embodied and referenced in FIG. 5, vias 62 may extend through each contiguous layer 46 at the same reference locations. The vias 62 are formed in the "green" state of the material using a punch or drill as is commonly known.

The arrangement of the vias 62 forms a first row 64 and a second row 66 corresponding to the perimeter of a longitudinal portion 30 of the desired waveguide filter 10. Therefore, the vias or slots 62 will trace a pattern of alternately spaced resonator and iris sections 42 and 67 respectively along a longitudinal axis. The distances between vias 62 in a first row 64 and a second row 66 correspond to the widths in the y-direction calculated for the desired waveguide filter 10. Particularly, the distances between the first and second rows 64 and 66 of vias 62 are set to exceed the calculated waveguide widths in the y-direction by the anticipated LTCC shrinkage component $\Delta y$ and relatively placed to account for the shrinkage $\Delta x$ in the x direction. Other vias, such as referenced at 63, may be added to conduct select signals through the contiguous layers 46. The vias 63 may serve to couple microwave frequencies to the input and output feeds 56 and 58.

Figure 6:
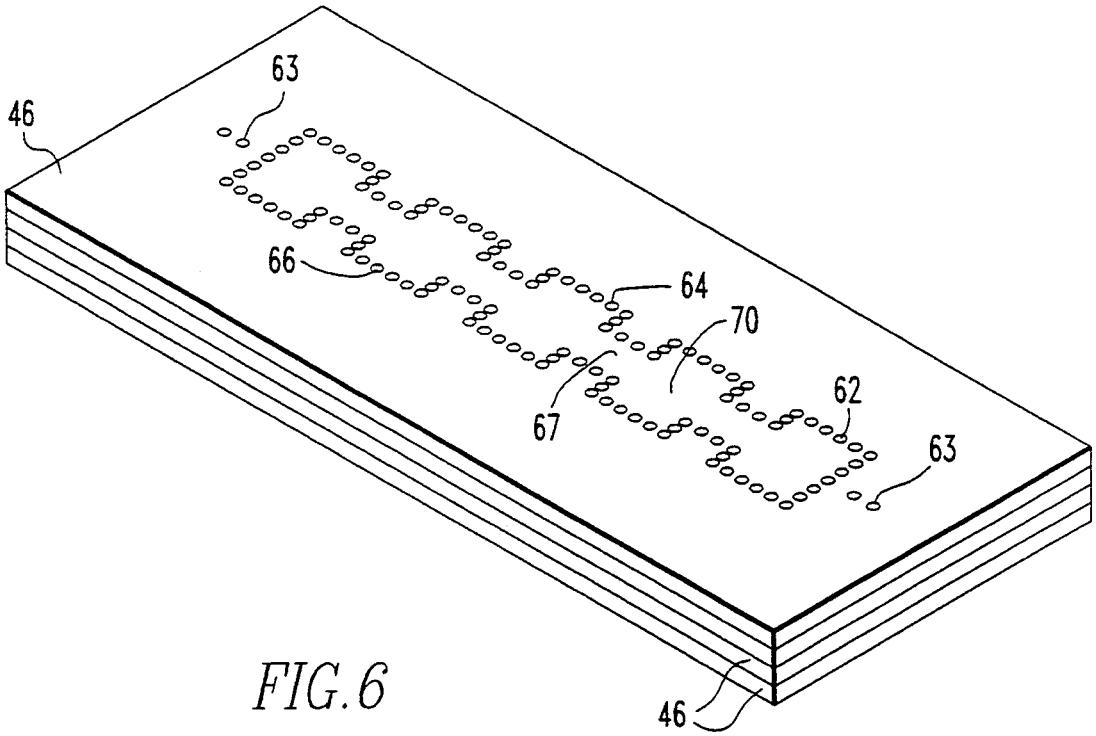
FIG. 6 is a perspective view of the contiguous layers shown in FIG. 5.

The vias 62 on each of the contiguous layers 46 are filled with a conductive material, preferably gold. Referring to FIG. 6, the contiguous layers are then stacked together so that adjoining surfaces of the layers 46 make mechanical contact. Because the vias 62 are formed at the same reference locations on each layer 46, corresponding vias on adjacent layers will align and also make electrical contact. After the contiguous layers 46 are stacked, the cumulation of first rows 64 and second rows 66 of vias 62 forms the vertical sides in the x–z directions of a waveguide filter embedded within surrounding low temperature cc-fired ceramic.

Figure 5:
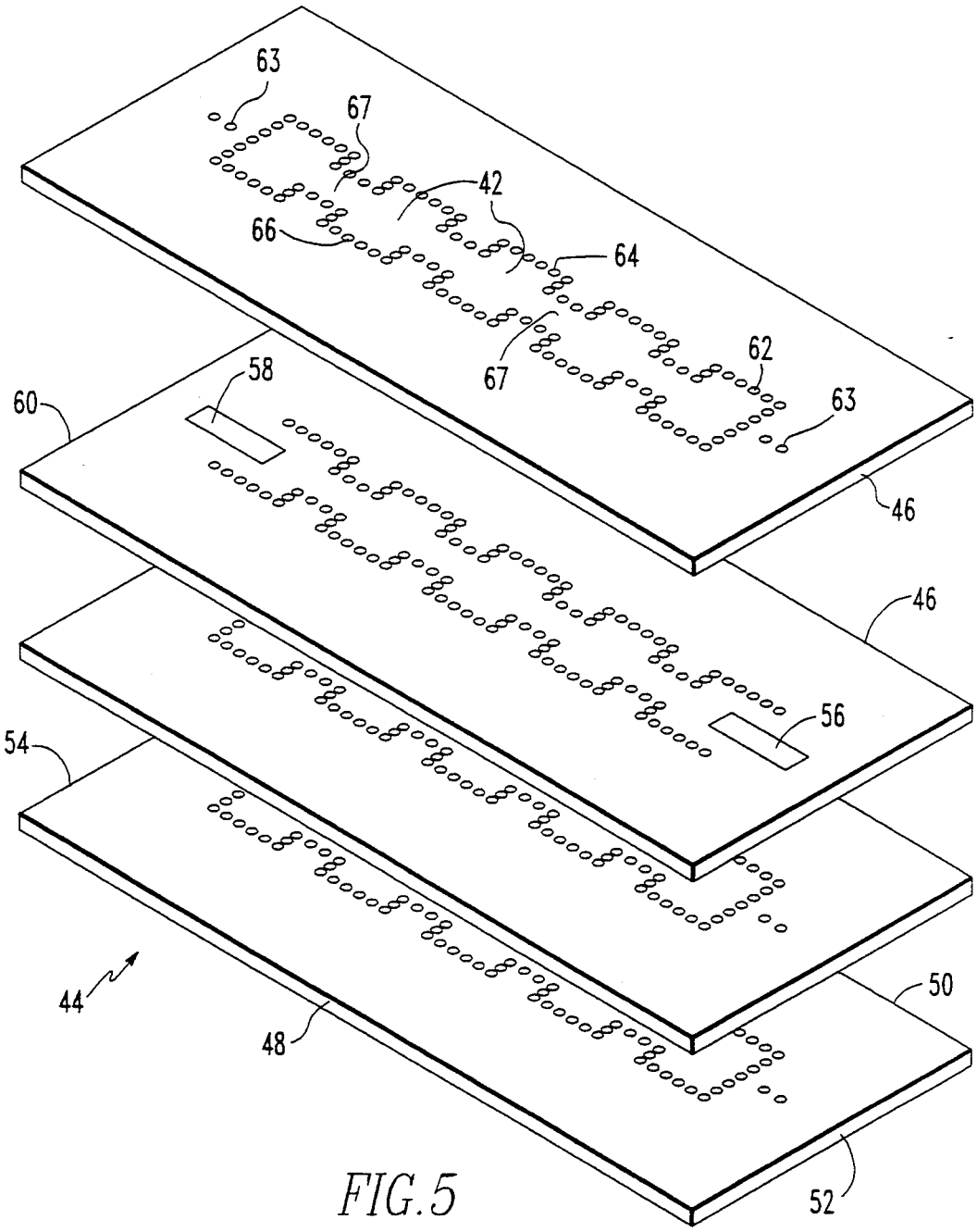
FIG. 5 is an exploded view of contiguous layers of ceramic according to the second embodiment of the present invention.
Figure 7:
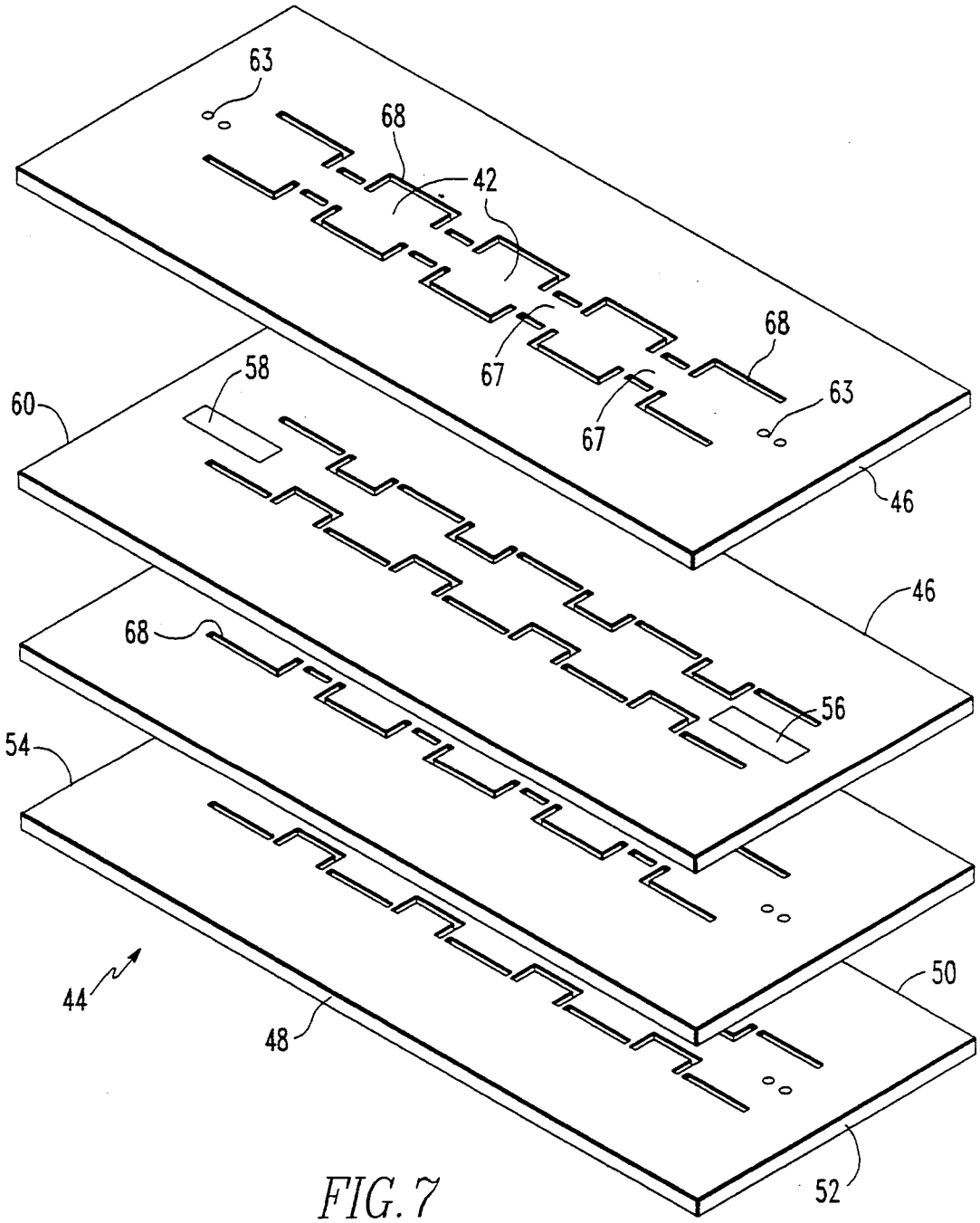
FIG. 7 is an exploded view of alternative contiguous Layers of ceramic according to the second embodiment of the present invention.

Referring to FIG. 7, at least two rows of slots 68, or orifices, may alternatively be formed in each of the contiguous layers 46 in place of the two rows 64 and 66 of vias shown in FIGS. 5 and 6 for defining the perimetric outline of a series of coupled resonators. Each slot 68 has at least one inner wall 70 aligned most closely with the center of the contiguous layer. The slots 68, like the vias 62, are dimensioned and positioned to correspond to the perimeter of a longitudinal portion 30 of the desired waveguide filter 10. Each slot 68 extends completely through the thickness of the LTCC layer, and may be formed through cutting or punching techniques, for example. The distances between the inner walls 70 and 71 of the slots 68 correspond to the width of the desired filter 10 and irises 31 in the y-direction. The slots are positioned on each layer 46 to account for anticipated shrinkage of the LTCC during co-firing. Each slot 68 is filled with a conductive via material, preferably gold, silver, or copper. When the contiguous layers 46 are stacked, the corresponding slots 68 on adjacent layers will align and make electrical contact. The cumulation of slots 68 between contiguous layers 46 forms the vertical sides of a waveguide filter 10 in the x–z directions. In addition to forming the sides of the filter 10, the conductive slots 68, or the conductive vias 62, help to conduct heat from the LTCC to the outside environment. Alternative arrangements for defining the perimetric outline of a series of coupled resonators are available. Each of the contiguous layers 46 could, for example, be dimensioned so as to form the outline as described above for the first embodiment.

Figure 4:
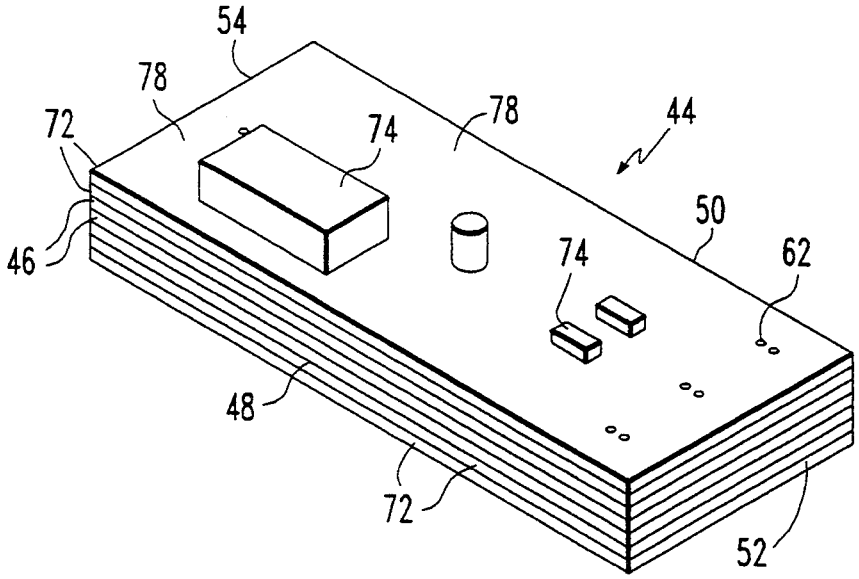
FIG. 4 is a perspective view of a waveguide switched filter bank according to a second embodiment of the present invention.

A conductive material 70, preferably gold, is deposited on a top surface and a bottom surface of the stacked contiguous layers, which in the configuration illustrated in FIG. 4 are buried layers in the structure 44. This conductor 70 covers at least the area bounded by the vias, i.e., the longitudinal portion 30 of the waveguide filter 10. Consequently, the conductor forms the horizontal sides of a waveguide filter 10 in the x–y directions. The stack of plated contiguous layers 46 resembles a rectangular block having gold plating on the top and bottom surfaces, which may or may not be buried within the structure 44 illustrated in FIG. 4, as explained below.

In accordance with the present invention, the laminated unit of the waveguide filter includes a top dielectric layer, a bottom dielectric layer, and a plurality of stacked dielectric layers between the top and bottom layers. As herein embodied, and referenced at FIG. 4, the waveguide filter 44 includes a plurality of individual layers 72 of ceramic material. These layers 72 are preferably cut as pieces from LTCC tape. The individual layers 72 may be selected so as to serve as a substrate for holding electrical circuit components when the contiguous and individual layers 72 and 46 are stacked together. These components 74 mounted on the individual layers could include digital, analog, power, radio frequency, microwave, millimeter wave, and optical devices, for example. To serve as the substrate for most discrete electrical components, the dielectric constant for the individual layers 72 would generally be in the range of 2 to 200. The layers of LTCC 46, which comprise the waveguide filter, may also be of a different dielectric constant than those layers forming the balance of the substrate layers 72, which electrically and mechanically support the components illustrated in FIG. 8. This allows the dielectric constant of each layering group to be tailored to the requirements of the waveguide filter and additional components.

Figure 8:
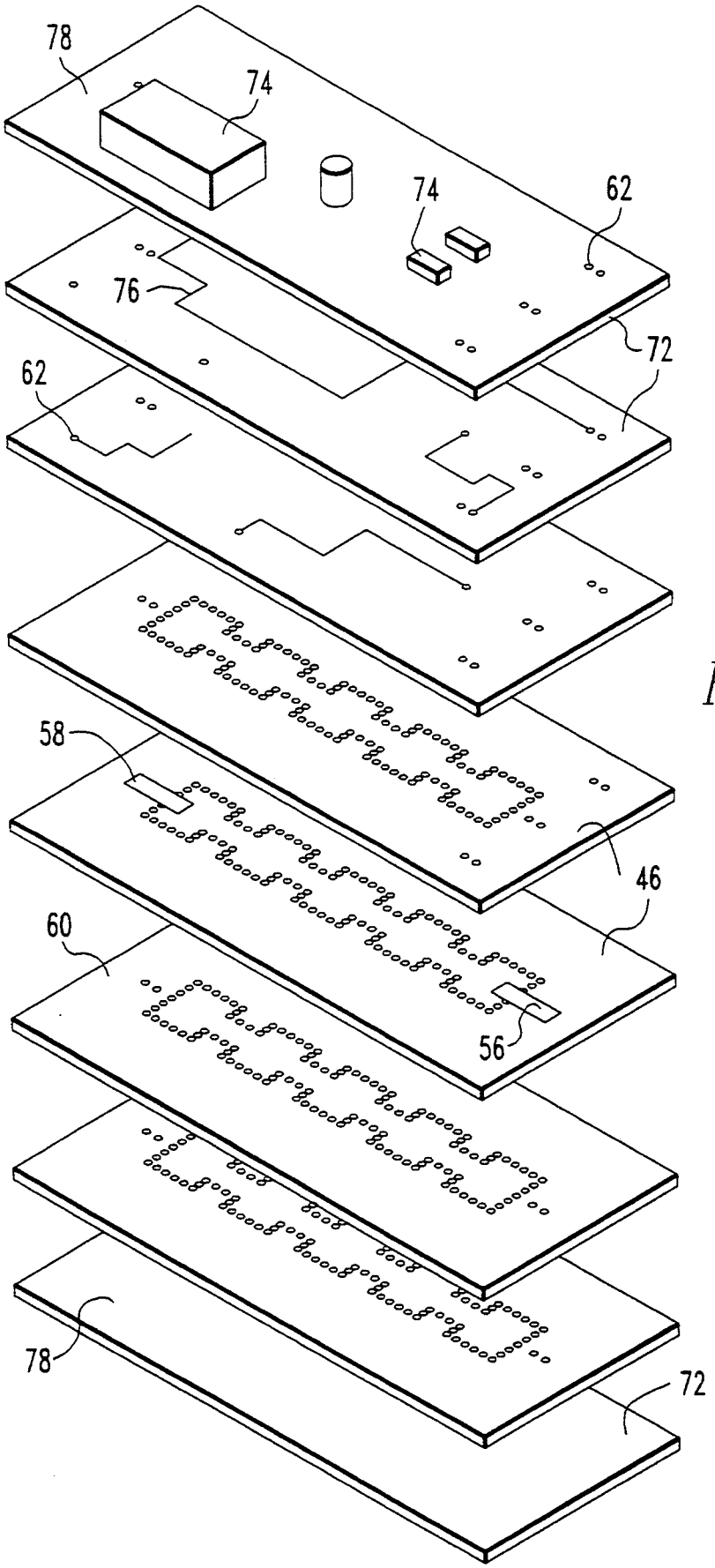
FIG. 8 is an exploded view of the waveguide switched filter bank shown in FIG. 4.

Referring to FIG. 8, signal paths 76 are plated on the surfaces of the individual layers as required to connect terminals of the electrical components 74. Likewise, vias 62 are formed and filled with conductive material in the individual layers 72 to connect the signal paths between adjacent layers.

The individual layers 72 of LTCC are arranged on either end of the stack of contiguous layers 46 of high dielectric LTCC. After arranging the layers 72 and 46 together, the rectangular structure is bonded to form a laminated unit of ceramic. For LTCC, bonding is preferably accomplished by co-firing. Under these conditions, the stack of contiguous and individual layers 46 and 72 of LTCC will contract predictably and result in a solid, monolithic structure generally referenced as 44 in FIG. 4.

The signal paths 76 and vias 62 create an embedded pattern of conductive paths between adjacent individual layers 72. The outermost layers 78 of low dielectric LTCC, for example, may include means for mounting circuit components. These means could comprise surface conductors or conductors in cavities to allow conventional chip component attachment through the use of epoxies, solders, or eutectic attachment as examples. Similarly, an RF connector or the like could be mounted on the surface of an outermost individual layer 78 to couple microwave frequencies to the substrate. Some of the vias 62 and signal paths 76 may be placed in the individual layers 72 and the contiguous layers 46 so as to connect to the input feed 56 and the output feed 58 on the select contiguous layer 60. In this way, the signal tracks 76 and the individual layers 72 serve to combine the waveguide filter 76 formed by stacking the contiguous layers 46 of LTCC with other circuit components 74 in a single, integrated package.

It will be apparent to those skilled in the art that various modifications and variations can be made to the present invention without departing from the spirit or scope of the present invention. For example, vias and signal paths could be placed within the contiguous layers of high dielectric material outside of the region for the waveguide filter. Thus, it is intended that the present invention cover the modifications and variations of this invention provided they come within the scope of the appended claims and their equivalents.

What is claimed is:

1. A waveguide filter, comprising a monolithic structure having a series of coupled resonators, the monolithic structure including:

a selected number of laminated dielectric layers, each of the laminated layers having means for defining a perimeter of the series of coupled resonators of a selected dimension;

the number of dielectric layers and the dimension of the perimeter being selected in accordance with a predetermined resonant frequency for the monolithic structure; and a plating of conductive material covering the monolithic structure.

2. The filter of claim 1, wherein each of the selected number of laminated layers has a configuration defining the perimeter of the series of coupled resonators.

3. The filter of claim 1, wherein the laminated layers have a plurality of adjacent metal-filled vias defining the perimeter of the series of coupled resonators.

4. The filter of claim 1, wherein the laminated layers have a metal-filled orifice for defining the perimeter of the series of coupled resonators.

5. The filter of claim 1, wherein the dielectric layers include pieces of low temperature co-fired ceramic.

6. The filter of claim 1, wherein the conductive material is gold.

7. A waveguide filter, comprising:

a laminated unit, the laminated unit including a top dielectric layer, a bottom dielectric layer, and a plurality of stacked dielectric layers between the top and bottom layers, a select number of the plurality of stacked dielectric layers having means for defining a perimetric outline of a series of coupled resonators of a waveguide filter, the number of stacked dielectric layers and the dimension of the perimetric outline being selected in accordance with a predetermined resonant frequency for the defined waveguide filter.

8. The waveguide filter of claim 7, further comprising an input feed and an output feed communicating with the series of coupled resonators.

9. The waveguide filter of claim 7, wherein at least one of the top and bottom layers has a planar exterior surface, and further comprises at least one electronic component mounted on said planar surface.

10. The filter of claim 7, wherein the select number of the plurality of stacked dielectric layers have a plurality of adjacent metal-filled vias defining the perimetric outline of the series of coupled resonators.

11. The filter of claim 7, wherein the select number of the plurality of stacked dielectric layers have a metal-filled orifice for defining the perimeter of the series of coupled resonators.

12. The filter of claim 7, wherein at least one of the select number of the plurality of stacked dielectric layers has a planar surface, said planar surface being plated with a conductive material.

13. The filter of claim 7, wherein the dielectric layers include pieces of low temperature co-fired ceramic.

14. The filter of claim 7, wherein the select number of the plurality of stacked dielectric layers have a higher dielectric constant than the top dielectric.

15. A method of fabricating a waveguide filter, comprising the steps of:

(a) selecting and stacking a plural number of contiguous layers of dielectric material;

(b) positioning vias through said contiguous layers to form a perimeter of a series of coupled resonators, each of said resonators being dimensioned and the number of contiguous layers being selected to resonate at a predetermined frequency;

(c) filling said vias with conductive material;

(d) covering a top surface and a bottom surface of the stack of contiguous layers with a conductive material;

(e) stacking a plurality of individual layers of dielectric material with said contiguous layers, the contiguous layers having a high dielectric constant relative to the individual layers;

(f) co-firing the stack of contiguous and individual layers to form a monolithic, laminated unit.

* * * * *